US008040291B2

(12) United States Patent
Yang et al.

(10) Patent No.: US 8,040,291 B2
(45) Date of Patent: Oct. 18, 2011

(54) F-INVERTED COMPACT ANTENNA FOR WIRELESS SENSOR NETWORKS AND MANUFACTURING METHOD

(75) Inventors: Bo Yang, McLean, VA (US); Felice M. Vanin, Rome (IT); Xi Shao, Potomac, MD (US); Quirino Balzano, Annapolis, MD (US); Neil Goldsman, Takoma Park, MD (US)

(73) Assignee: University of Maryland, College Park, MD (US)

( * ) Notice: Subject to any disclaimer, the term of this patent is extended or adjusted under 35 U.S.C. 154(b) by 340 days.

(21) Appl. No.: 12/470,905

(22) Filed: May 22, 2009

(65) Prior Publication Data

US 2010/0026605 A1 Feb. 4, 2010

Related U.S. Application Data

(60) Provisional application No. 61/055,518, filed on May 23, 2008.

(51) Int. Cl.
*H01Q 9/30* (2006.01)

(52) U.S. Cl. ..... 343/895

(58) Field of Classification Search ..... 343/895, 343/872, 866–867

See application file for complete search history.

(56) References Cited

U.S. PATENT DOCUMENTS

| | | | | |
|---|---|---|---|---|
| 4,914,450 | A * | 4/1990 | Dilley et al. | 343/895 |
| 7,295,161 | B2 * | 11/2007 | Gaucher et al. | 343/700 MS |
| 7,598,915 | B2 * | 10/2009 | Ieda et al. | 343/713 |
| 2002/0018026 | A1 * | 2/2002 | Noro | 343/895 |
| 2005/0001769 | A1 * | 1/2005 | Qi et al. | 343/700 MS |

* cited by examiner

*Primary Examiner* — Huedung Mancuso
(74) *Attorney, Agent, or Firm* — Rosenberg, Klein & Lee

(57) ABSTRACT

An F-inverted compact antenna for ultra-low volume Wireless Sensor Networks is developed with a volume of 0.024λ×0.06λ×0.076λ, ground plane included, where λ is a resonating frequency of the antenna. The radiation efficiency attained is 48.53% and the peak gain is −1.38 dB. The antenna is easily scaled to higher operating frequencies up to 2500 MHz bands with comparable performance. The antenna successfully transmits and receives signals with tolerable errors. It includes a standard PCB board with dielectric block thereon and helically contoured antenna wound from a copper wire attached to the dielectric block and oriented with the helix axis parallel to the PCB. The antenna demonstrates omnidirectional radiation patterns and is highly integratable with WSN, specifically in Smart Dust sensors. The antenna balances the trade offs between performance and overall size and may be manufactured with the use of milling technique and laser cutters.

20 Claims, 12 Drawing Sheets

SOLDER HERE
12

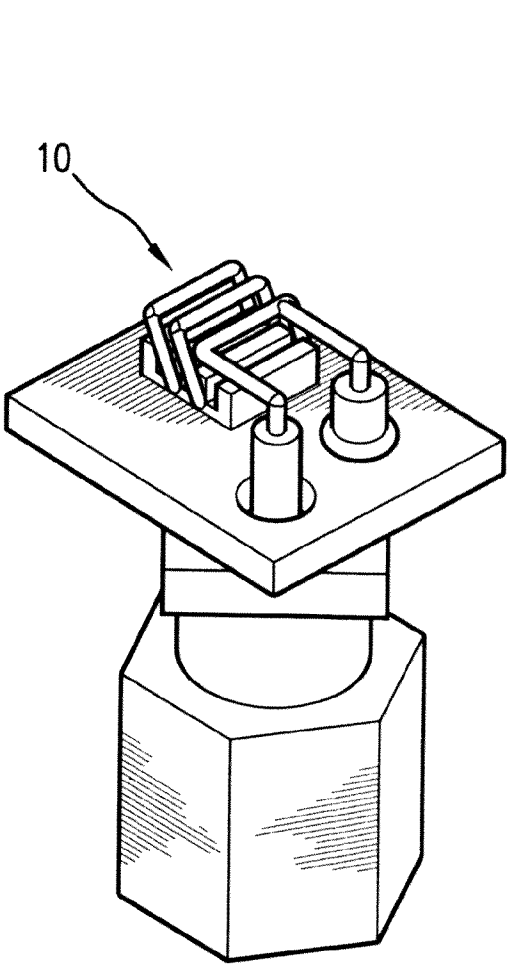
FIG.6G
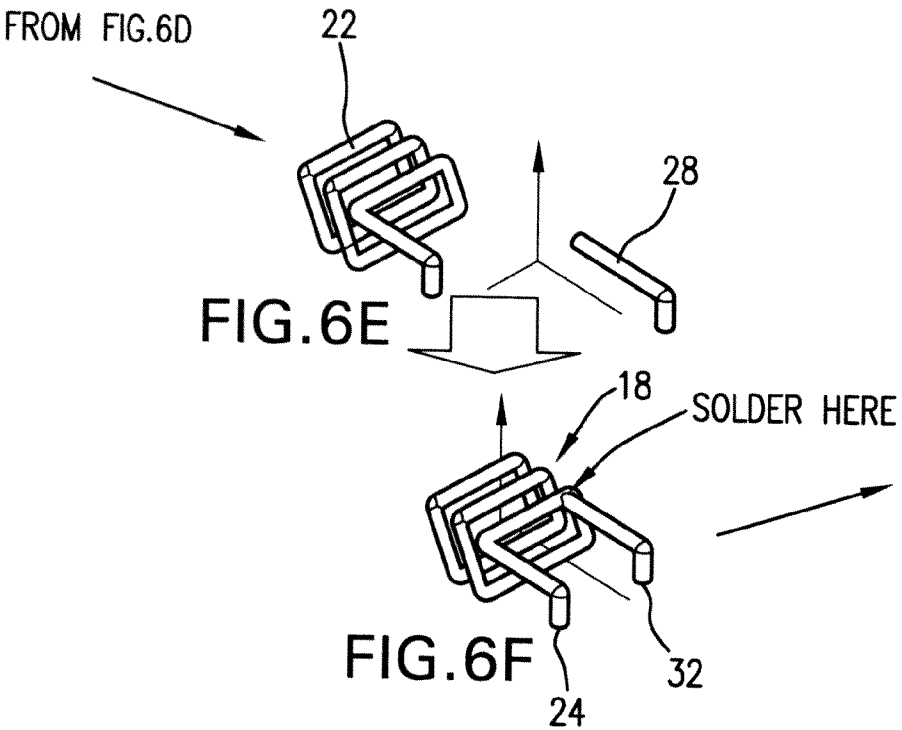
FIG.6E
FIG.6F

F-INVERTED COMPACT ANTENNA FOR WIRELESS SENSOR NETWORKS AND MANUFACTURING METHOD

REFERENCE TO RELATED APPLICATIONS

This utility patent application is based on Provisional Patent Application Ser. No. 61/055,518 filed 23 May 2008.

The work was funded by NSA Contract Number H9823004C0490. The United States Government has certain rights to the invention.

FIELD OF THE INVENTION

The present invention is directed to Wireless Sensor Networks (WSNs) and in particular, to a compact antenna compatible with ultra-low volume Wireless Sensor Network applications.

More in particular, the present invention is directed to a compact antenna for highly integrated transceivers having an omni-directional radiation pattern optimized for maximum efficiency and bandwidth.

Still further, the present invention is directed to a low profile F-inverted compact antenna (FICA) for Wireless Sensor Networks with reduced size and acceptable gain and bandwidth performance achieved by "bended" helix design of the antenna element with the axis parallel to the antenna's ground plane which is easily scalable to different operating frequencies.

BACKGROUND OF THE INVENTION

The rapid progress in personal wireless communication devices has made the development of the Electrically Small Antennas (ESAs) the center of research interests. A large variety of miniature antennas has been developed with the emergence of mobile handheld devices. The success of these devices largely relies on the progress and innovation in dielectric materials, the optimization of size, gain, and bandwidth.

Integrated circuit antennas (Chip antennas), Planar Inverted F Antennas (PIFA), and printed circuit board (PCB) antennas (e.g. Meander antennas, inverted L antennas, printed monopole antennas and printed dipole antennas) are popular antennas available in today's market, which are widely used in different wireless hand held devices. However, in order for these antennas to effectively radiate or receive energy when used as transmitting or receiving antennas, they need a ground plane of an appropriate size. Chip antennas from various companies, such as Johanson Technology, Mitsubishi, Matrix Electrica, S.L, Antenna Factor, Raisun, etc., all require a specific PCB size. Usually, at least one edge of these PCBs should have a minimum of a quarter wavelength at its operating frequency.

One of the major design highlights of these commercial antennas is focused on the space/volume dual-usage realized by sharing the ground plane of the antenna and the circuits. Since the current is most significant on the edge of the ground plane, the center portion of the ground plane that serves as the return path of the circuit signals will have less of an effect from the antenna radiation. Some of these antennas are adopted for hand-held applications, such as cell phones and PDAs. Others are used in blue-tooth devices, such as wireless mouse and keyboards. The approximate quarter wavelength ground plane size required by the antenna in these applications is still within the range of the package for the end-user products. Therefore these antennas are widely accepted in wireless devices.

However, in some Wireless Sensor Network (WSN) systems, such as the Smart Dust systems, different application constraints are employed. SmartDust is a Wireless Sensor Network system intended to be used in sensing signals for civil or military purposes. The key challenges of the SmartDust prototyping are power, size, cost and sensing. SmartDusts can detect any target signal, such as sound, vibration, light, the environment temperature, humidity for industry factories, warehouses, plantings, poultry or animal husbandry, or can monitor patients conditions, etc. Some applications require thousands of SmartDust sensors distributed over a large area. They are usually disposable simply because it is not practical to collect SmartDusts and reuse them. Therefore, wireless sensor nodes in the WSN systems with low power consumption and low cost are very important. In military and other applications, it is preferred to hide the SmartDusts, e.g., the size of these sensors should not be noticeable. Ideally, these sensors should be as small as sand or dust. Obviously, antennas requiring a large ground plane are not compatible with SmartDusts and cannot be applied in these areas.

In addition to the many common requirements in ESAs for conventional handheld devices, such as low cost, light weight, compactness, gain and bandwidth performance, antennas in ultra low volume Wireless Sensor Network (WSN) applications, such as in SmartDust systems, have stricter dimensional limitations and demand for omnidirectional radiation for the following reasons:

First, in each WSN transceiver node, all components, such as sensor, antenna, battery, transceiver integrated circuit (IC), as well as the reference ground plane (normally a printed circuit board) for IC and antenna are to be stacked or integrated in a package with a total volume of only a few $mm^3$ to one $cm^3$, where only a fraction of this volume is left for an antenna. The millimeter or centimeter scale dimensions are often much less than a quarter wavelength at the operating frequency (i.e., $0.1\lambda$ or less). For example, in conventional ESA designs, a ground plane with a minimum quarter wavelength dimension is often necessary for proper performance. In the ISM bands (916/828/433 MHz), this ground plane size is between 8 to 16 cm. Though this is a reasonable size to be fit within a cell phone or a PDA's housing, it is too large to be integrated into SmartDust sensor nodes in WSN communication package, whose node size is on the order of a few $cm^3$ or smaller. A package with a low height and a large ground plane area is not suitable for WSN applications. In WSN, the ground plane size must be decreased as well as the height of the antenna. This requires new designs to reduce both factors and keep the antenna highly functional.

Second, in WSN/SmartDust applications, a large amount of transceiver nodes are distributed randomly. These transceiver nodes, as well as the antennas associated with them, are oriented in various directions and form an autonomous communication network. Each communication node in this network is a complete self powered transceiver node, which requires the antenna to have a radiation pattern as omnidirectional as possible to transmit and receive signals from all directions due to the random orientation of the nodes.

Third, there is no need for a base station in WSN/Smart Dust applications. Any node in the network may serve as a base station. These nodes cover a large communication range by multi-hops. The communication distance is determined mainly by the separation of nodes, and can range from 1 to 10 m. Therefore, the gain of antenna is traded against the volume requirement.

Thus there is a need in SmartDust WSN applications for an antenna which occupies a volume no larger than 20 mm×25 mm×8 mm, which is 0.06λ×0.076λ×0.024λ (for a particular operating frequency of 916 MHz), and which has an omnidirectional a radiation pattern in order to transmit to and detect signals from random directions. The desired compact antenna also must be optimized for maximum efficiency and bandwidth, since small antennas inherently have high Q or low efficiency.

SUMMARY OF THE INVENTION

It is therefore an object of the present invention to provide a compact antenna compatible with ultra-low volume Wireless Sensor Network applications for highly integrated transceivers having an omnidirectional radiation pattern and optimized for maximum efficiency and bandwidths which are compatible with the antenna's miniature dimensions.

It is a further object of the present invention to provide a low profile compact antenna with a ground plane size as small as few percent of the resonance wavelength and which is easily scalable for a broad range of frequencies such as 916 MHz-2500 MHz bands while maintaining satisfactory performance.

It is still an object of the present invention to provide an electrically small antenna with a design which balances the trade offs in terms of communication distance, stringent geometrical size limits, bandwidths and antenna efficiency.

It is an overall object of the present invention to provide an F-inverted compact antenna built for specific Wireless Sensor Network (WSN)/Smart Dust applications in which the antenna occupies a volume no larger than 20 mm×25 mm×8 mm, e.g. 0.06λ×0.076λ×0.024λ for a particular ISM (Industrial, Scientific and Medical) band of 916 MHz and which is scalable for even higher operating frequencies such as 2.2-2.5 GHz).

In one aspect of the present invention, an F-inverted compact antenna for ultra-low volume Wireless Sensor Network (WSN) includes a ground plane board, a dielectric block attached to the ground plane board at a predetermined location, a helically contoured wire member attached to the dielectric block and disposed with the axis of the helically contoured member oriented substantially in parallel to the surface of the ground plane board.

The helically contoured member includes a pre-wound wire portion which has first and second ends and a plurality of coils therebetween. A wire part is soldered at one end thereof to the pre-wound wire portion at a predetermined tapping position. The first end of the pre-wound wire portion is used as a feeding end of the compact antenna, and another end of the wire part opposite to the soldered end thereof is used as a shorting end.

The dimensions of the compact antenna in question, e.g., the volume occupied thereby, are adapted to be compatible with ultra-low volume Wireless Sensor Networks, for example SmartDust sensors, and therefore do not exceed mm or maximum cm scale. The dimensions of the compact antenna dependent on a desired operational frequency are easily scalable to the desired operational frequency. For example, for the operating frequency in the range of 906 MHz-926 MHz, a volume occupied by the compact antenna is in the range of 0.06λ×0.076λ×0.024λ, where λ is a resonating wavelength of the compact antenna.

The helically contoured member of the antenna is formed from a wire, preferentially copper, of a diameter in the range approximately between 0.5 mm-0.8 mm. The tapping position may be defined by a tap distance between the feeding and shorting ends of the antenna which is preferably in the range between 0 mm-4 mm for the identified antenna's dimensions.

The ground plane board may have dimensions in the range below 10-20 mm by 12-25 mm. The shorting end of the antenna is shorted to the ground plane board, specifically to the shorting pin of an SMA connector, while the feeding end of the antenna is coupled to a feeding pin of the SMA connector. The ground plane board may be made from a material such as FR4 with a layer of copper plate embedded therein.

The dielectric block to which the helically contoured member is attached is shaped as a preferably rectangular member from Teflon or Lexan® material and has a plurality of receiving structures, such as parallel grooves or channels penetrating through the dielectric block, and formed with predetermined dimensions and at locations in full cooperation with the dimensions of the helically contoured member, such as the diameter of the wire used, pitch between the coils, dimensions of the coils, etc. For 916 MHz operating frequency, the dielectric block may have dimensions in the range below 4-5 mm×1.5-2.5 mm×15 mm, and may be positioned approximately 4-5 mm from an edge of the ground plane board. A spacing between the coils in the helically contoured member may be approximately 2.5 mm. In order to adopt the compact antenna in question to the operating frequency range of 2.2-2.45 GHz, the dimensions of the compact antenna may be scaled. It was found that in this higher operational frequency arrangement, it is desired to provide a volume occupied by the compact antenna in the range of approximately 10 mm×10 mm×10 mm.

The length of the wire used to form the helically contoured member depends on the desired operating frequency of the compact antenna and may be adjusted during the manufacturing procedure. For example, for the operating frequency range of 2.2 GHz-2.45 GHz, the length of the wire used for the helically contoured member may range from 30 mm to 50 mm.

As another aspect of the present invention, there is provided a method for manufacturing an F-inverted compact antenna for ultra-low volume Wireless Sensor Networks which includes:

forming a dielectric block having a plurality of substantially parallel receiving structures of predetermined dimensions and spaced a predetermined distance one from another, attaching the dielectric block to a surface of a ground plane board at a predetermined position, pre-winding a wire of a predetermined length and diameter into a helically contoured member having a plurality of coils coordinated with the receiving structures of the dielectric block, soldering a wire part of a predetermined length to a predetermined tapping location at a respective one of the plurality of coils of the helically contoured member, attaching the helically contoured member to the dielectric block with the axis of the helically contoured member oriented substantially in parallel to the surface of the ground plane board, wherein each of the coils of the helically contoured member is received in a respective one of the plurality of receiving structures (grooves or channels) of the dielectric block, coupling an end of the helically contoured member to a feeding point, and shorting the wire part to the ground plane board.

Prior to soldering the respective ends of the antenna to the feeding and shorting pins provided, the resonating frequency of a helically contoured member with the wire part soldered thereto may be measured, and the pre-wound wire may be trimmed until the resonating frequency approaches a desired operating frequency of the compact antenna.

The antenna in question is designed specifically for integration with the ultra small transceiver such as a Smart Dust Sensor.

These and other objects of the present invention will become apparent when considered in view of further description accompanying the patent Drawings.

BRIEF DESCRIPTION OF THE DRAWINGS

FIGS. 6A-6G show schematically the sequence of operations for manufacturing the compact antenna of the present invention;

DESCRIPTION OF THE PREFERRED EMBODIMENTS

Figure 1:
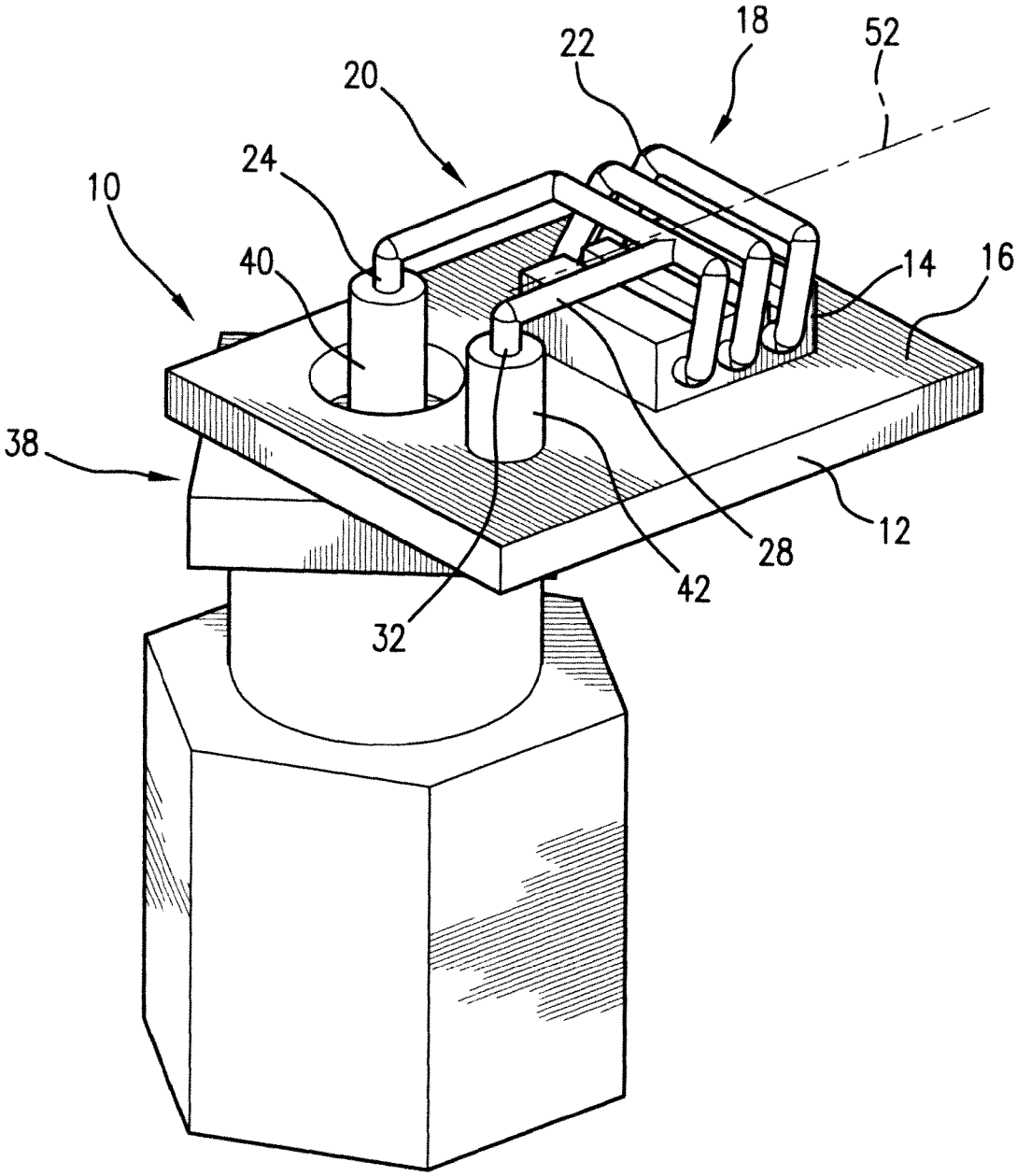
FIG. 1 is a schematic representation of an antenna module of the present invention.

Several fundamental limitations of electrically small antennas are taken into consideration and explored to guide the design of the compact antenna 10 of the present invention. First, Radiation Resistance (Rr) is analyzed which decreases by the square of the height of the antenna. For example, the typical Radiation Resistance (Rr) of an antenna with a height of $\lambda/20$ above a ground plane is only a fraction of an Ohm. Without a proper matching network, transferring power into and from a standard 50 Ohm port becomes practically impossible. Given this limitation, maximizing the possible height of the antenna proves to be critical for achieving proper power transfer in small antenna design.

The small size of an antenna not only limits the Rr, but also increases the capacitive input reactance, and a large inductive tuning reactance L is needed to bring the resonance frequency to the desired value. The quality factor can be expressed as $Q=\omega L/Rr$, where $\omega$ is a resonance frequency. With a large L and a small Rr, Q is large, indicating a narrow bandwidth for the antenna. Generally, small antennas suffer from limited gain and bandwidth product. Reducing the size of small antenna and their ground plane, may further decrease their efficiency and gain. As a result, when designing the electrically small antenna in question, it is preferable to use all the possible volume was used to maximize the size of the tuning reactance. Small antennas are effective only if they can carry relatively large current with consequently possible high Ohmic losses. The Ohmic resistance due to the skin effect at the operating frequency (916 MHz) cannot be neglected considering the low radiation resistance of small antennas. This Ohmic loss reduces the already low gain of these antennas. For this reason, small cross-section conductors such as metal strips are poor materials for small antennas. Therefore, the current compact antenna is designed with the use of a wire instead of strip lines.

With the above-listed guidelines, a novel F-inverted compact antenna (FICA) 10, shown in FIGS. 1, 2A-2D and 6G has been designed. The novel compact antenna 10 includes a ground plane board 12, a dielectric block 14 attached to the ground plane board 12 at a predetermined position on the surface 16 thereof, and a helically contoured member 18 formed of a wire 20

The helically contoured member 18 comprises a pre-wound wire portion 22 which has two ends 24 and 26, and a wire part 28 soldered to the pre-wound wire portion 22 at a predetermined tapping point 34. The wire part 28 is soldered to the pre-wound wire portion 22 at a predetermined location (tapping point) 34 defined by a tap distance which is selectively calculated, as will be further discussed. The wire part 28 is soldered at the tapping end 30 thereof to the pre-wound wire portion 22. An opposite (shorting) end 32 of the wire 28 is shorted to the ground plane board 12 as will be disclosed in detail further herein.

The antenna 10 formed with the helically contoured member 18 attached to the dielectric block 14 and secured on the ground plane board 12 is coupled to the SMA connector 38 through a feeding pin 40. A shorting pin 42 is provided on the ground plane board 12 for shorting the antenna thereto.

The ground plane board 12 is a printed circuit board (PCB) made, for example, by FR4 with a copper plate embedded as a layer inside. The ground plane board 12 has an opening 44 serving as a passage for the feeding pin 40, and an opening 46 at which the shorting pin 42 is soldered. For different modifications of the compact antenna 10 in question, the PCBs 12 of different dimensions can be used, all, however, are compatible with ultra-low volume Smart Dust applications. As an example, Table 1 represents parameters for the PCB 12 used for 2.2/2.45 GHz antenna.

Parameters for PCB

TABLE 1

| | |
|---|---|
| Ø (diameter of the feeding opening) | 3 mm (fixed) |
| Ø (diameter of the shorting opening) | 1.7 mm (fixed) |
| d1 (distance between centers of the feeding and shorting openings) | 3.6 mm (fixed) |
| PCBX (length) | 10 mm |
| PCBY (width) | 12 mm |
| d2 (distance from the center of the feeding opening to an edge of the PCB) | 3 mm |
| d3 (distance from the center of the feeding opening to another edge of the PCB) | 3 mm |
| PCBH (thickness of the PCB) | 0.508 mm~3.175 mm (Depends on Advanced Circuit manufacture) |

Dimensions of the ground plane boards of alternative compact antennas designed for different operating frequencies will be presented further herein.

Figure 3B:
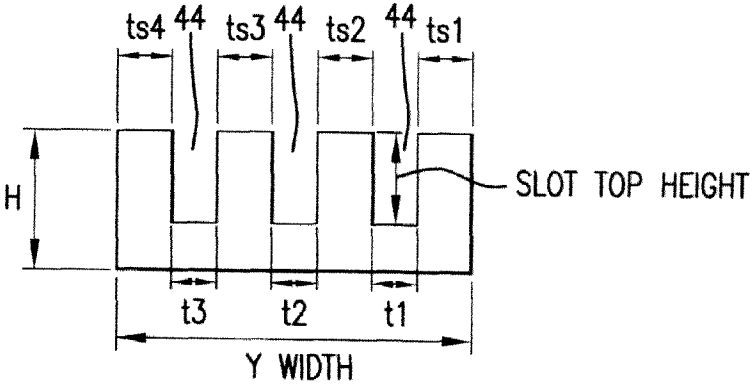
FIGS. 3A and 3B show respectively a perspective and side view of the grooved dielectric block of the present invention.
Figure 3C:
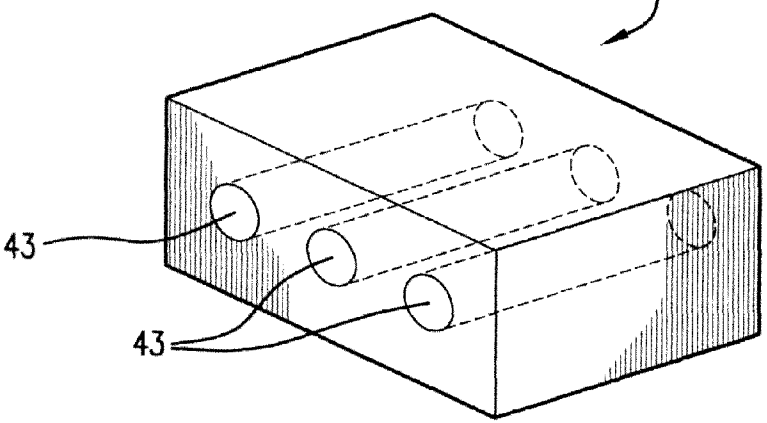
FIG. 3C shows a dielectric block formed with channels.
Figure 3A:
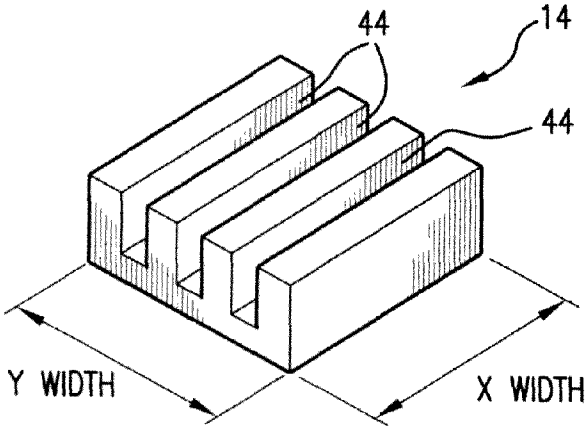

The dielectric block 14 serves as a supporting block, as well as for the reduction of the overall volume occupied by the compact antenna in question. Preferably, the dielectric block 14 is of a rectangular shape with receiving structures formed either as channels 43 passing therethrough, as shown in FIG. 3C, or as grooves 44 best presented in FIGS. 1, 3A-3B, 6D and 6G.

In a grooved modification, the dielectric block 14 has substantially parallel grooves 44, the dimensions and positioning of which are commensurate with the design of the helically contoured member 18. Specifically, the width of the grooves 44 corresponds to the diameter of the wire 20 used for the helically contoured member 18, while the length of the grooves (coinciding with the width of the dielectric block 14) is selected in accordance with the dimensions of the coils 46 of the helically contoured member 18. The distance between the grooves 44 corresponding to the pitch between the coils 46. The dielectric supporting block may be made of Lexan®, Teflon, or other suitable dielectric material. Milling technique and/or laser cutting may be used in fabrication of the dielectric block 14. Table 2 represents the parameters of the dielectric block 14 for a 2.2/2.45 GHz antenna of the present invention presented in FIGS. 3A-3B. These parameters are variable for other operating frequencies as will be presented further herein. The location of the dielectric block 14 on the PCB 12 may be defined at a distance 4-5 mm from the edges thereof.

Parameters for Lexan® GE Block

TABLE 2

| | |
|---|---|
| Xwidth | 4 mm (fixed) |
| Ywidth | 4 mm (fixed) |
| H | 1.5 mm (fixed) |
| ts1 | 0.7 mm |
| ts2 | 0.6 mm |
| ts3 | 0.6 mm |
| ts4 | 0.6 mm |
| t1 | 0.5 mm |
| t2 | 0.5 mm |
| t3 | 0.5 mm |
| SlotTopHeight | 1.0 mm |

The SMA connector 38 is the SMA PCB mount jack formed of Amphenol at which 3 out of 4 ground pins are removed, leaving the feeding pin 40 for connection with the feeding end 24 of the helically contoured member 18.

The wire 20 used for the helically contoured member 18 and the wire part 28 is preferably copper plated steel wire with the diameter of 0.5 mm-0.8 mm. The total wire length used for the helically contoured member 18 is the sum of the sections L1-L12 shown in FIGS. 4A-4D and 5A-5C.

Figure 4A:
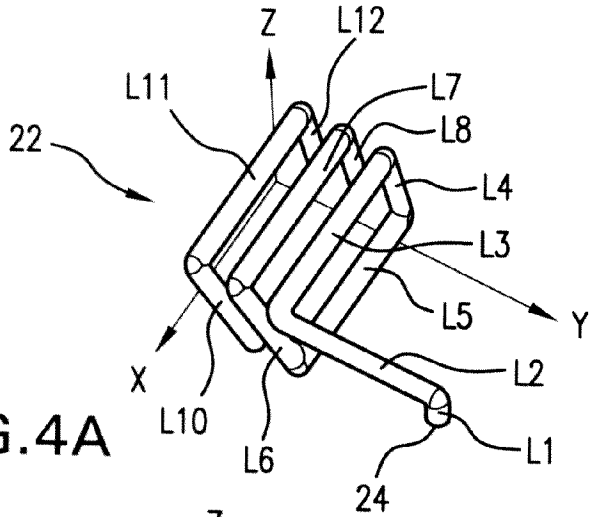
FIGS. 4A-4D show in detail the structure of the helically shaped wire unit of the present invention.
Figure 4B:
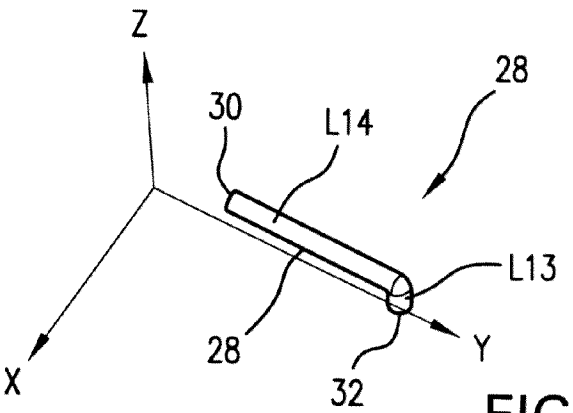
Figure 4C:
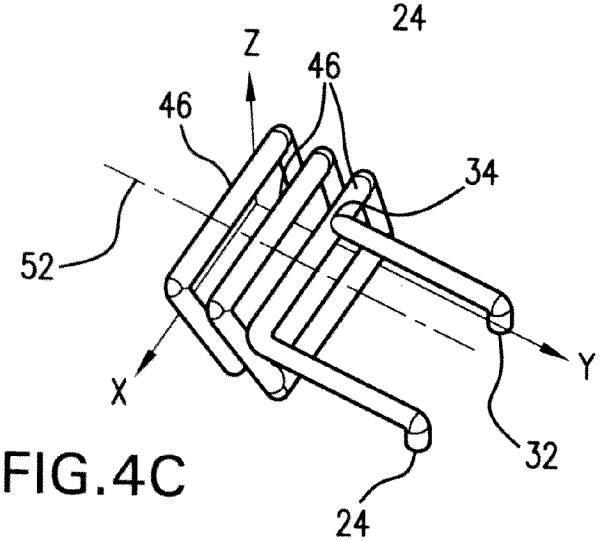

The wire part 28 presented in FIG. 4B includes a section L14 and L13 and is soldered to the pre-wound wire portion 22 at the tapping point 34. Table 3 represents parameters for the pre-wound wire portion 22 of the 2.2/2.45 GHz antenna. The total wire length is the sum of the pieces L1-L12 of the pre-wound wire portion 22 and is approximately 46.9 mm (a quarter wavelength for 2.2 GHz is 34 mm, and for 2.45 GHz is 30.6 mm). The length of the section L1 depends on the easiness to solder to the feeding pin of the SMA connector.

Parameters for Pre-Wound Wire

TABLE 3

| | |
|---|---|
| L1 | 0.75 mm to 4 mm (note1) |
| L2 | 4.25 mm |
| L3 | 5 mm |
| L4 | 2.5396 mm |
| L5 | 5 mm |
| L6 | 3 mm |
| L7 | 5 mm |
| L8 | 2.5396 mm |
| L9 | 5 mm |
| L10 | 3 mm |
| L11 | 5 mm |
| L12 | 2.5396 mm |
| θ1 | 90 degree |
| θ2 | 78.7 degree |
| θ3 | 53.13 degree |
| θ4 | 90 degree |
| Dw | 0.5 mm |

Figure 4D:
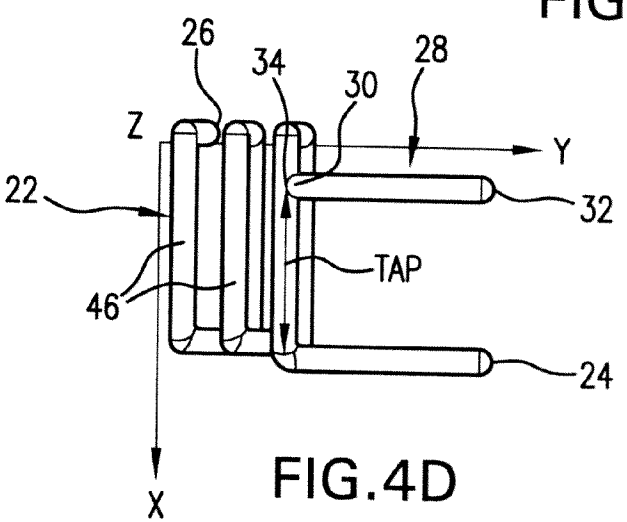
Figure 5C:
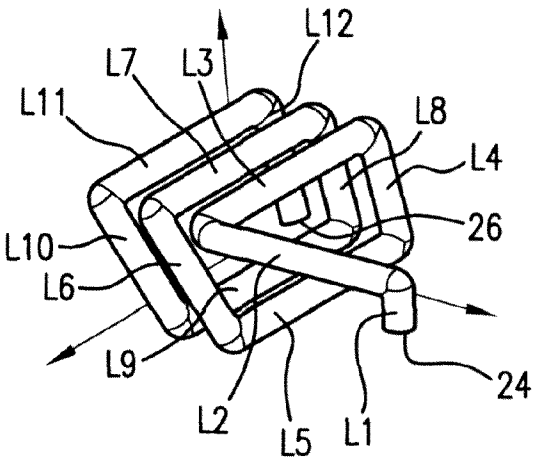
FIGS. 5A-5C are respectively top, side and perspective views of the pre-wound wire portion of the helically contoured member of the present invention.
Figure 5A:
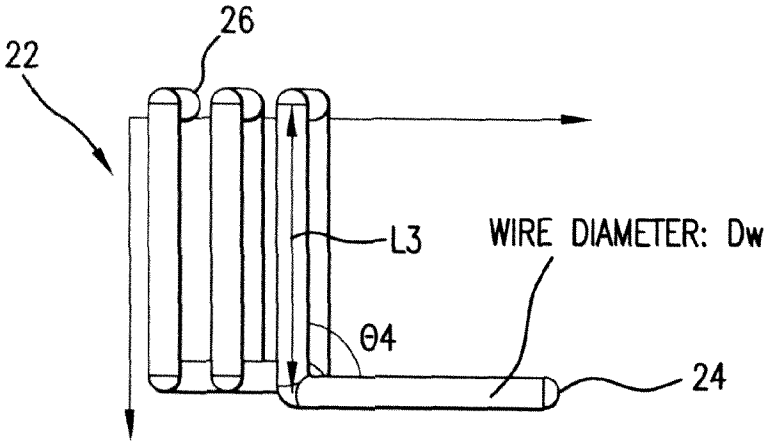
Figure 5B:
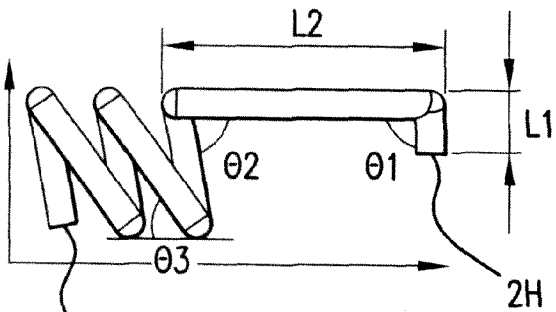

Table 4 represents parameters for the wire part 28. The length of L13 depends on the easiness to solder to the shorting pin 42, but it is preferably not longer than 4 mm. The tapping position 34 defined in FIG. 4D, is one of the most important parameters for the compact antenna 10, which is defined as: tapping distance=$L_1$+$L_2$+t. For the dimensions shown in Table 4, the tapping distance measured from the feeding point ranges from 5 mm to 13.57 mm. The results of the study performed to find the optimal tapping position, will be presented further herein.

Parameters for Wire Part

TABLE 4

| | |
|---|---|
| L13 | 0.75 mm to 4 mm |
| L14 | Length varies; should match the length of tap<br>(L 14 = sqrt((d1 − tap)^2 + L2^2))<br>(So L14 varies between 4.25 mm to 5.57 mm) |
| tap | 0 mm to 4 mm |

Figures 6A, 6B, 6C, 6D:
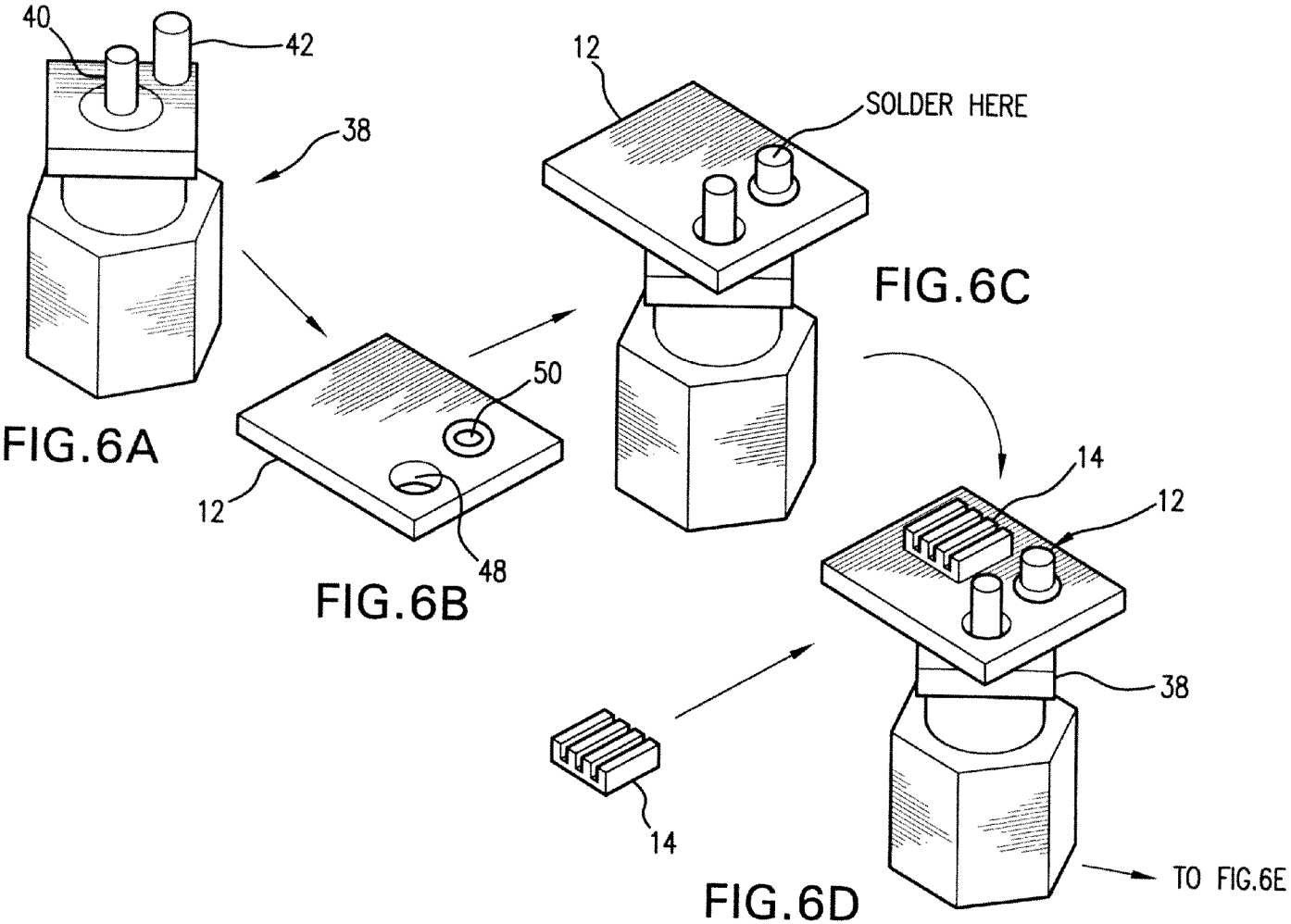

Referring to FIGS. 6A-6G, the process for manufacturing of the compact antenna 10 is presented. On FIG. 6A, the SMA connector 38 is prepared with the feeding pin 40 and shorting pin 42 on the ground plate 12. Further, as shown in FIGS. 6B-6C, the ground plane board (PCB) 12 having an opening 48 for the feeding pin 40 and an opening 50 for the shorting pin 42 is soldered onto the ground plane of the SMA connector 38.

As presented further in FIG. 6D, the dielectric block 14, for example Lexan® block with the grooves, is attached to the surface 16 of the ground plane board 12 at a predetermined distance (4-5 mm) from the edges. The dielectric supporting blocks are manufactured either with holes on the sides or grooves separated by certain pitches. The wire 20 is then pre-wound to a helix 22 in accordance to the pitches defined in the dielectric block either between the holes on the side thereof or between the grooves. Further, the pre-wound wire portion (helix) 22 and the wire part 28 shown in FIG. 6E are soldered together at the tapping point 34, as shown in FIG. 6F, and the entire helically contoured member 18 is attached to the dielectric block 14 by inserting the coils 46 into the grooves 44. The feeding end 24 of the pre-wound wire portion 22 and the shorting end 32 of the wire part 28 are soldered respectively to the feeding pin 40 and the shorting pin 42, as shown in FIG. 6G.

Figure 8:
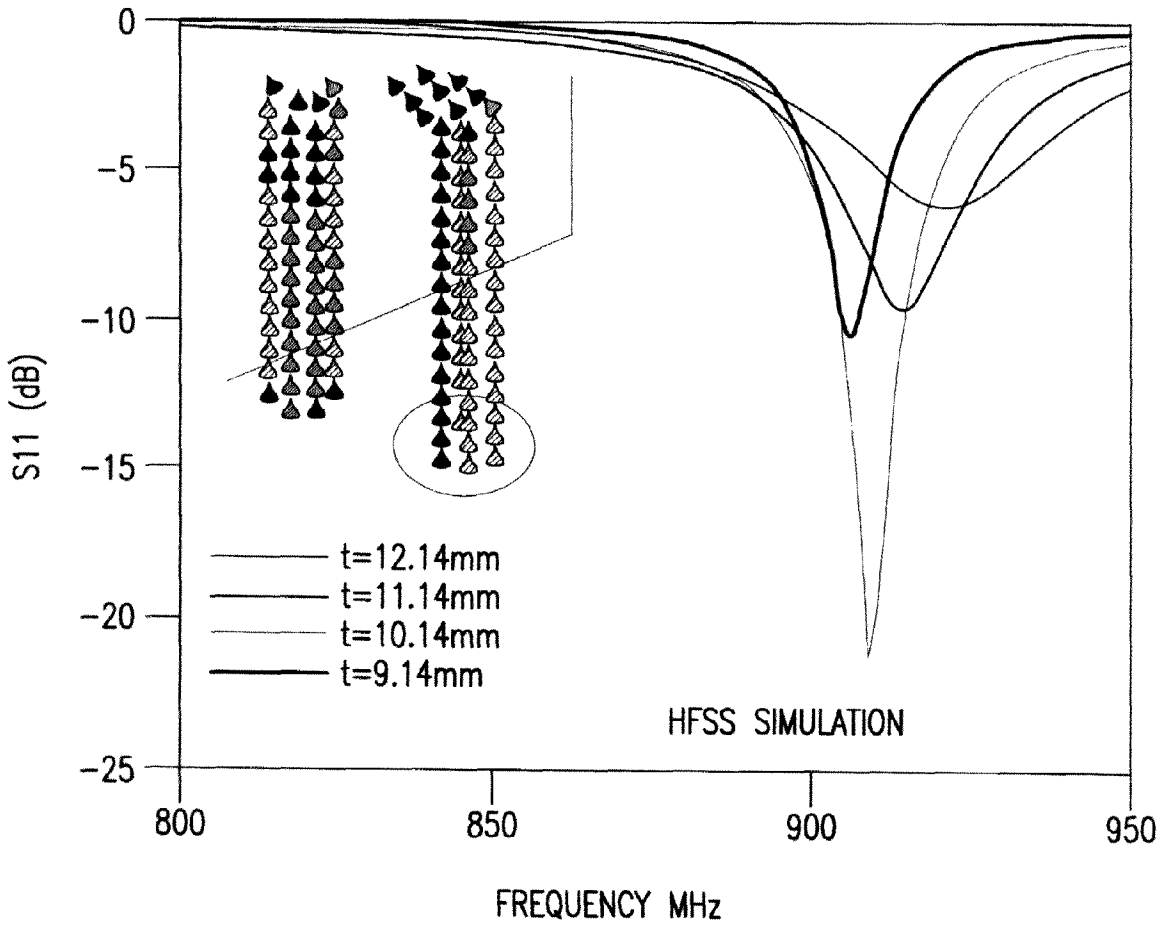
FIG. 8 is a diagram showing the simulation effect of the tapping distance.

Prior to the soldering, measurements of the resonating frequency may be needed. For this routine, the end 24 of the pre-wound wire portion 22 is electrically soldered to the feeding pin, 40 (defined as the SMA connector signal point when testing or RF front end transceiver circuit input/output point when in application) in order to make a solid connection, while the end 26 of the wire 20 of the pre-wound wire portion 22 is left electrically open. The resonating frequency of the compact antenna 10 is then measured, and the length of the helix wire is trimmed until the resonating frequency approaches a desired operating frequency of the antenna. The end 30 of the short wire part 28 is soldered to the tapping point 34 on the helix. The location of the tapping point 34 can be obtained from simulation (HFSS) presented in FIG. 8, or from experiment. When the antenna reaches a minimum reflection at the operating frequency, the tapping point 34 is selected as the tapping position. Generally, the tapping point is located close to the shorting end of the helix. The end 32 of the wire part 28 is soldered to the shorting pin 42.

Prior to the initiation of the manufacturing process a decision is made for the desired operation frequency which defines the length of the wire 20 for the helically contoured member 18. The length of the wire 20 is selected a little longer than the quarter wavelength of the operation frequency. The ground board size, the antenna height and the wire diameter are also determined in accordance to specific application requirements. Whenever possible, it is advisable to choose the largest numbers for all these dimensions.

Several samples of the compact antenna were built for the range of 916 MHz operating frequency, and the antenna was scaled to higher frequencies in the range of up to 2500 MHz. As an example only, but not to limit the dimensions of the compact antenna to the specific size shown in FIGS. 2A-2D, a 916 MHz FICA was fabricated with the total volume (including the ground plane) of approximately 8 mm×20 mm×25 mm. Other dimensions of the antenna are also within the scope of the present invention as long as they are compatible with the WSN applications.

S11 Simulation and Measurement

The S11 of the FICA was simulated with Ansoft HFSS software. The results are shown as dashed line in FIG. 7. Near the operating frequency, the antenna first resonates with a high impedance value, and then rapidly shifts into a low impedance resonating point. The measured S11 is shown as solid line on the same figure. The measured center frequency is 915.2 MHz, and the −3 dB bandwidth is 22.4 MHz. A triple Bazooka balun was applied when measuring the S11 of the antenna, which suppresses the radiation induced by the current on the feed cables. The embedded plot on the right hand side in FIG. 7 shows a picture of the balun fed AUT.

Figure 7:
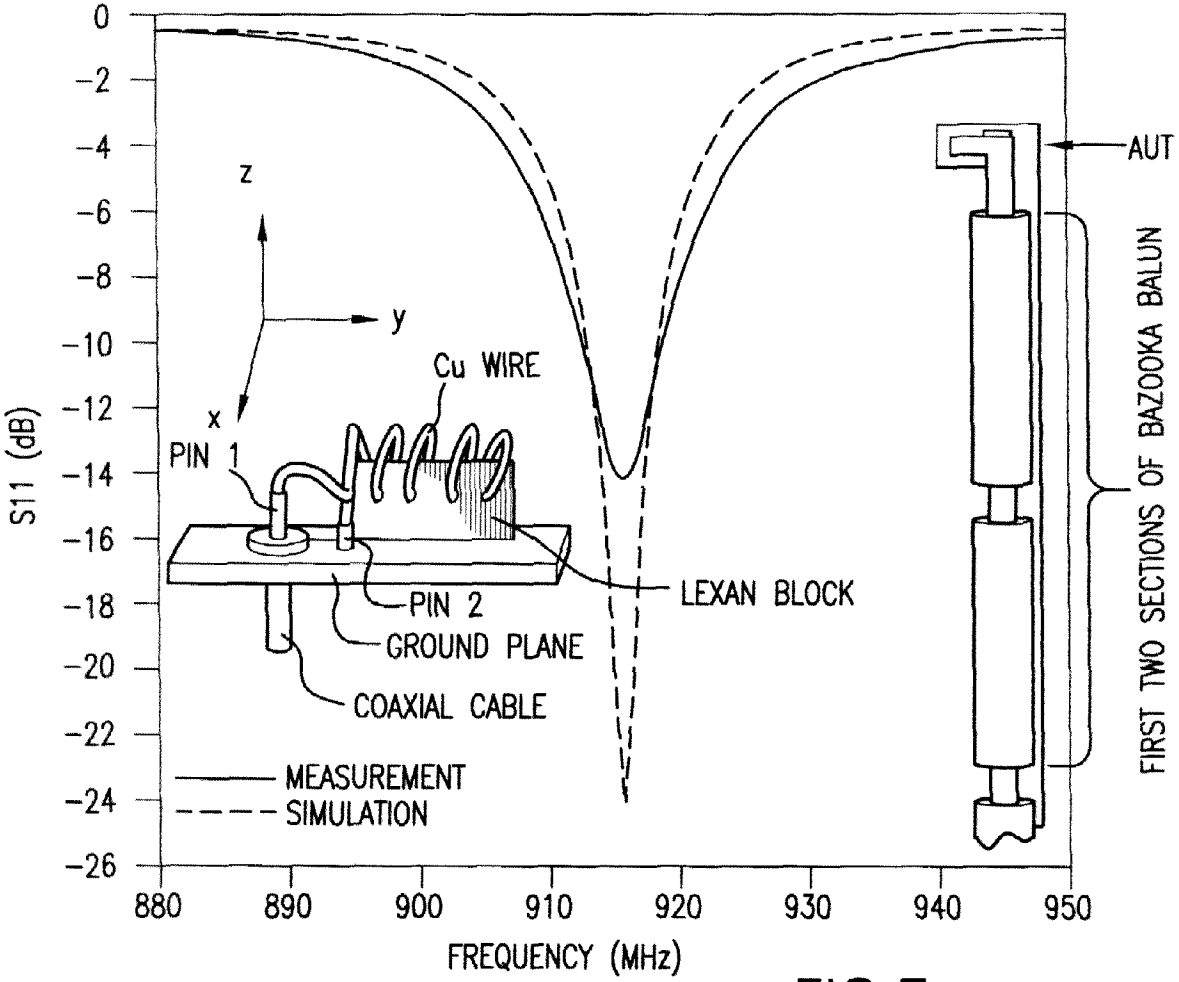
FIG. 7 is a diagram showing simulated and measured S11 of the compact antenna of the present invention.

The FICA structure simulated with Ansoft HFSS is shown as an inset in FIG. 7. The ground plane is an FR4 printed circuit board (PCB) with a size of 20 mm×25 mm, which is constrained by the circuit board dimension imposed from Smart Dust WSN requirement. A 0.8 mm diameter copper wire is wound as a helix into a 15 mm×2.5 mm×5 mm dielectric block made from Lexan® with relative permittivity of 2.96 and loss tangent <0.001. The Lexan® block provides mechanical support to the antenna, which helps to reduce the effect of vibrations.

To minimize the length of the helix, the dielectric block size is selected to maximize the coupling to ground without increasing the inter-coil capacitance. The coils are maximally spaced without loss of inductance. This helix enables the antenna to resonate at the desired frequency with a much shorter length than a straight wire, or a meandering line. Antenna height and volume are selected to maximize the radiation efficiency. With the helical axis parallel to the PCB, the height of the integrated antenna is 8 mm above its ground plane satisfying the volume design restrictions.

One end of the helical copper wire is shorted to the ground plane (the PCB) and the other end is free (FIG. 7). According to HFSS parametric simulations, the spacing of each helical loop was chosen to be 2.5 mm, while the distance from the helix to the ground plane was chosen to be 3 mm. The distance between the ground short and the feeding pin was tuned to achieve a good match at the operating frequency. The antenna under test (AUT) was fed by metal pin 1 soldered to a SMA connector through a hole in the PCB.

Radiation Mechanism

It is important to realize that the FICA in question is different from omnidirectional mode helix antennas, whose turns support a net current in the axial direction producing a dipole-type radiation pattern. An efficient helical antenna could not be used in the SmartDust application because its height above a ground plane would have exceeded the relative specification. The helically contoured member 18 with its axis 52 parallel to the ground plane of the present model antenna, as shown in FIG. 1, is used to tune the capacitance of a very short radiator.

In the antenna 10, the helix acts as a resonant transmission line matching the reactance of a short monopole (0.024λ), but not as an antenna. The radiation from the helix is nearly suppressed by the proximal ground. The antenna radiating currents flowing in the two vertical wires are in phase, as in inverted F antennas (IFAs), which is observed in the HFSS simulation. They cause the azimuth omnidirectional radiation pattern and the polarization of the antenna. The current on the helix gives only a small contribution to the radiation of the FICA, which was further verified through polarization measurements. The ground plane used is the minimum possible size to avoid current leakage issue.

This design not only offers a height reduction, it also has the additional advantage that the relatively strong magnetic field confined inside the coils are unlikely to penetrate into the RF circuits which are integrated on the other side of the small ground. This makes the RF circuits more immune to electromagnetic interference from the antenna.

Figure 2B:
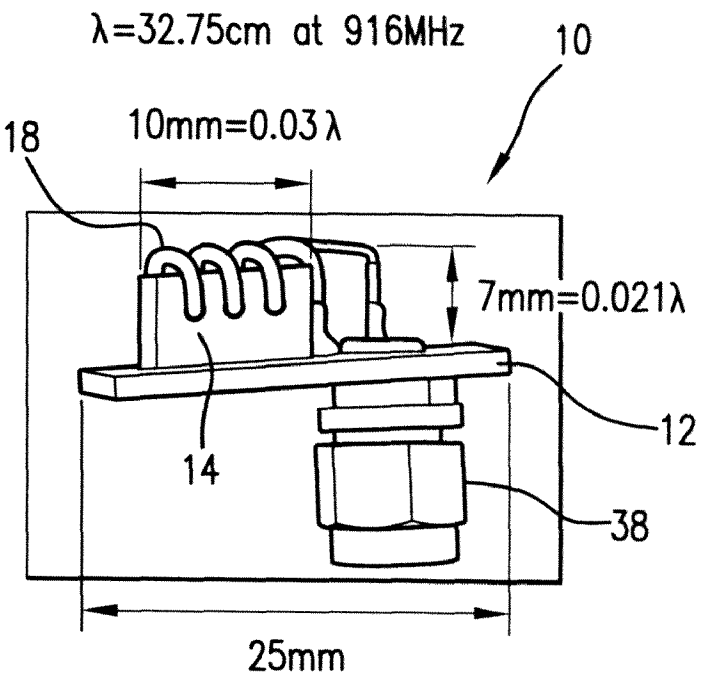
FIGS. 2A-2D show respectively top and side views of the antenna module of the present invention.
Figure 2A:
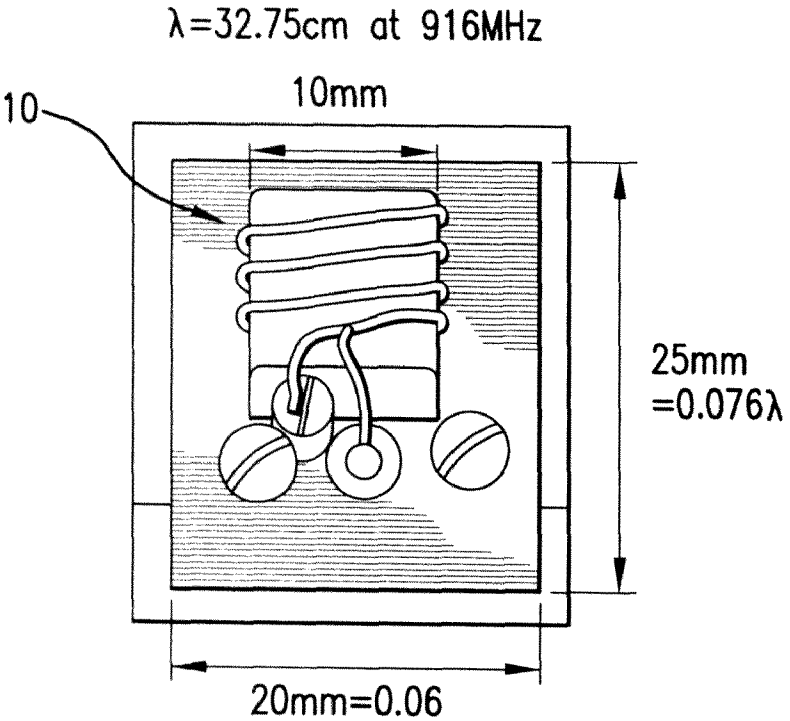
Figure 2D:
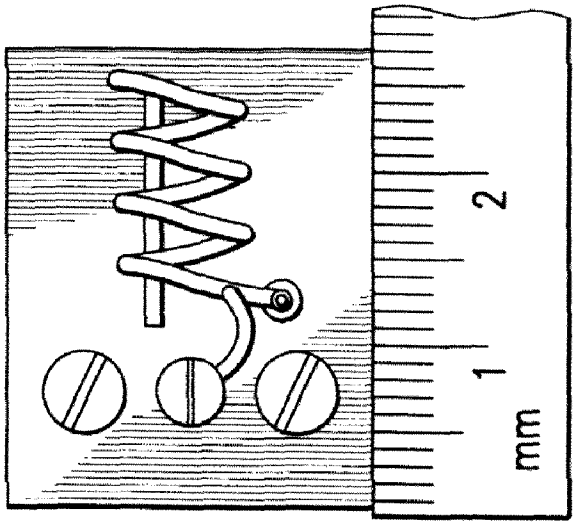
Figure 2C:
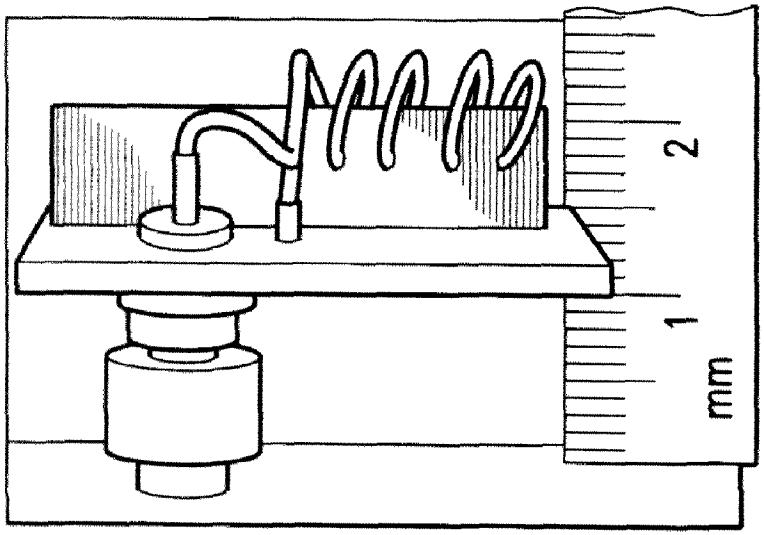

Another F-inverted compact antenna (FICA) with a reduced size and acceptable gain and bandwidth performance, was built with a 0.5 mm diameter copper wire wound and embedded into a 10 mm×10 mm×6 mm Teflon block with relative permittivity of 2.1. In FIGS. 2A-2B, Pin1 and Pin2, which are the feeding pin and the shorting pin, respectively, are of 7 mm in height. This antenna is fed by a SMA connector through a via in the FR4 ground plane. Ansoft simulations showed that the current densities in both shorting and feeding pins are in phase, so both pins are effective radiating components for the antenna. The position of the feeding pin tap (parameter t in FIG. 4D) was carefully selected. From Ansoft simulations and experiments, it was found that reducing t lowers the resonance frequency, because the antenna effective length increases.

Figure 9:
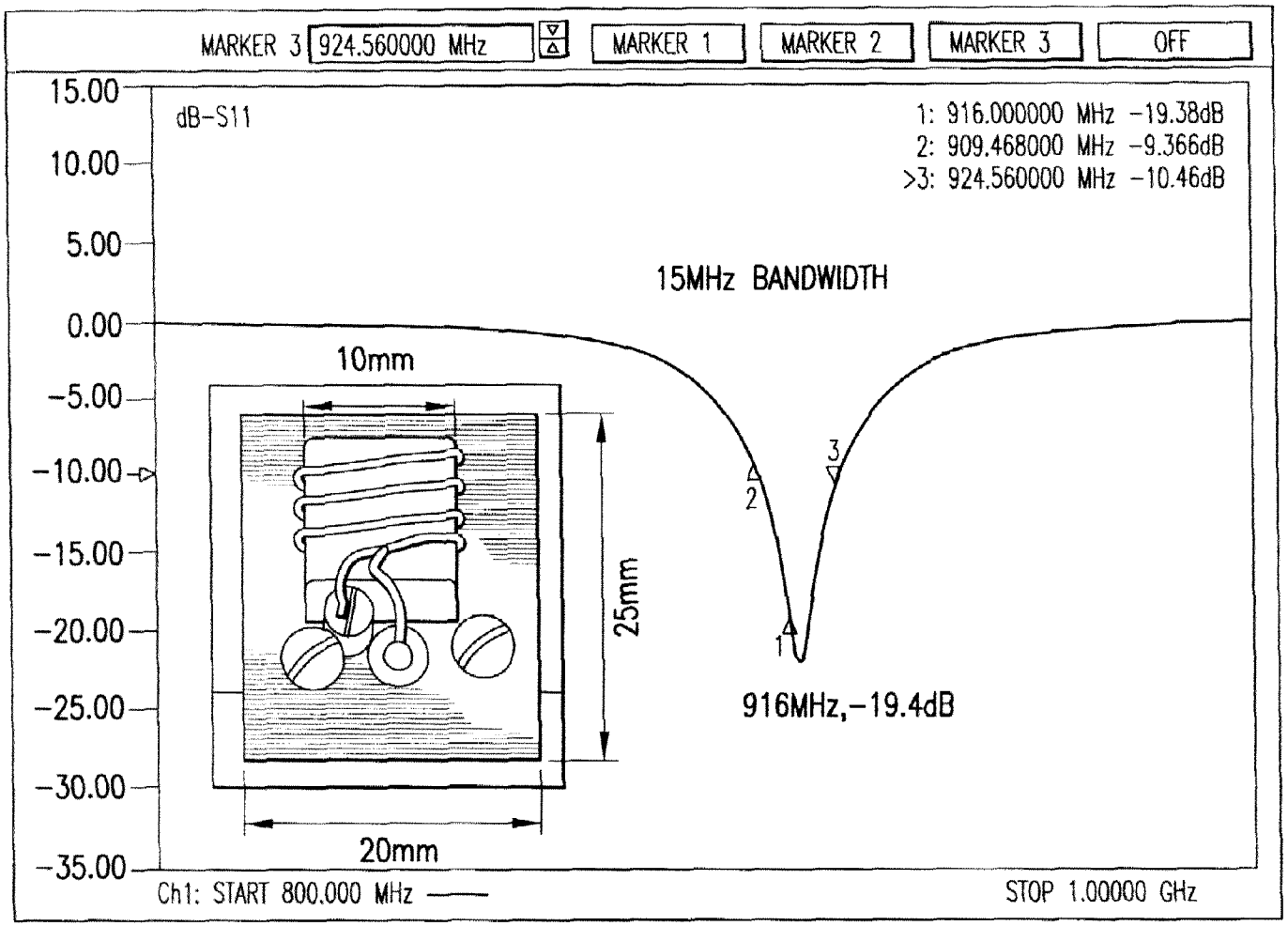
FIG. 9 is a diagram representing measured match and bandwidths characteristics of the compact antenna of the present invention.

After carefully tuning the tapping point on a very small ground plane (20 mm by 25 mm), the prototyped 916 MHz FICA was measured with an Agilent 8364B Vector Network Analyzer. FIG. 9 shows the measured S11 of the FICA. As one can see, the antenna resonates at 916 MHz. The −10 dB bandwidth is 15 MHz, about 1.6% of its center frequency. The total volume of this antenna is 20 mm×12 mm×7 mm.

Gain Measurement

The FICA radiation patterns were measured in an Anechoic chamber at the Electromagnetics and Wireless Laboratory, Food and Drug Administration (10903 New Hampshire Avenue, Silver Spring, Md. 20993). Two antennas were placed on stands 2 m above the floor on the anechoic chamber. The test antenna was placed on a rotary device which increased the azimuth angle by 10 degrees. The transmitting antenna was fed by a signal generator (HP8647A). A spectrum analyzer (HP 8560E) was used to observe signal levels at the receiving antenna.

Figure 10:
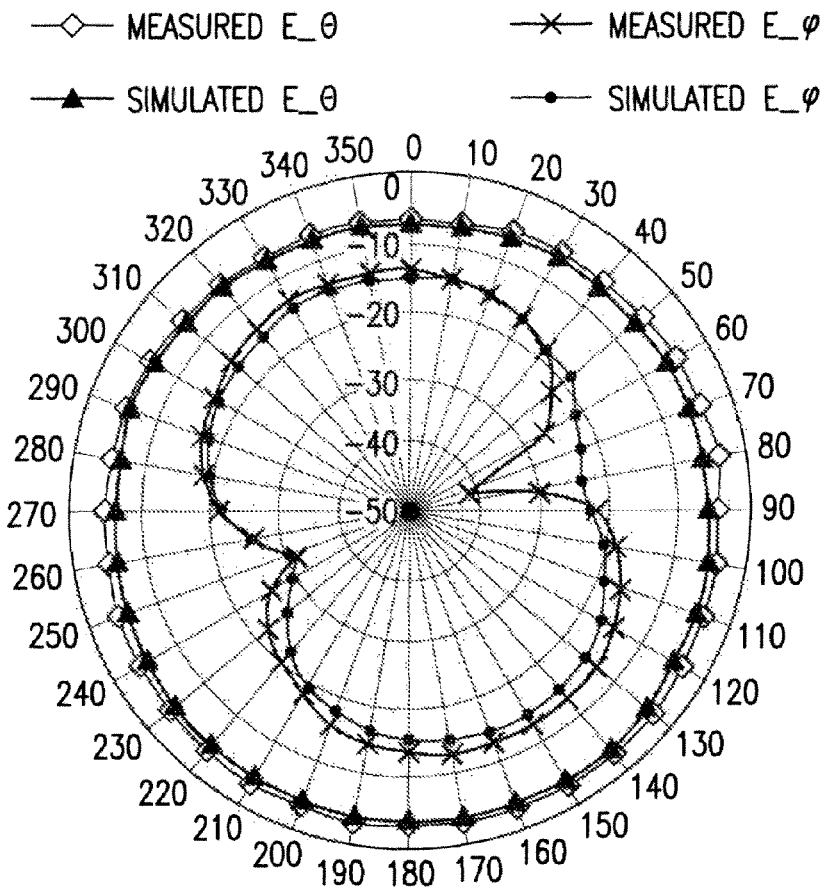
FIG. 10 is a diagram representing radiation pattern measurements.
Figure 11:
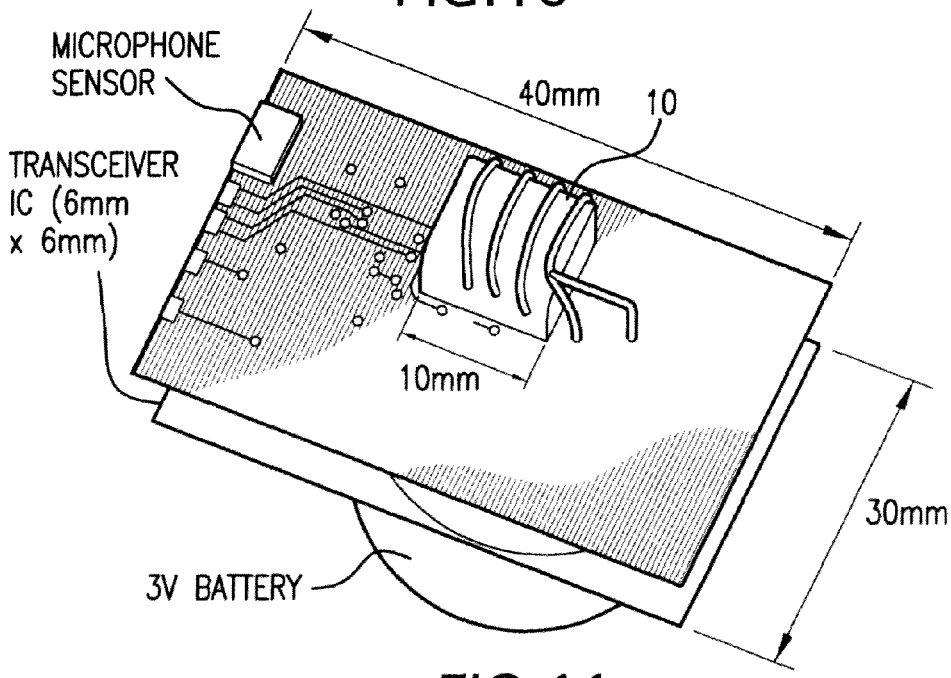
FIG. 11 is a perspective view of the compact antenna of the present invention incorporated with the Wireless Sensor Networks.

5 dBm RF signals were transmitted from the antenna, and the RF power level at the receiving antenna was recorded. First, the gain of two identical half-wave length dipoles was measured. This value was used as the 0 dB gain reference in FIG. 10. One of the dipoles was replaced with the FICA, and the receiving power vs. azimuth angle was measured. In FIG. 10, the pattern of the antenna is shown when the feeding and shorting pins are parallel to the transmit dipole ($E_\theta$, co-polarization), and when the two pins are perpendicular to the dipole ($E_\theta$, cross polarization). It is clear that the antenna has much higher gain for the co-polarization than for the cross polarization. The HFSS simulations showed that the current flowing in the two vertical pins, the feeding and the shorting pin, are in phase. The co-polarized radiation due to these vertical pins is stronger and has a uniform pattern. Measurement and simulation results both indicate that the FICA works as a dipole as opposed to an omnidirectional mode helical antenna.

The measured gain of the FICA is 3.53 dB lower than a standard half wave dipole, which indicates FICA's gain is −1.38 dBi. The antenna efficiency is about 48.53%. Considering that the total volume occupied by this FICA, including the ground plane, is only 2.4% λ×6% λ×7.6% λ, this small antenna is very efficient. A performance comparison of this work to other ESAs is summarized in Table 5.

Antenna Performance Summary

TABLE 5

| Type of ESA | Genetic Algorithm | PIFA | IFA | FICA |
|---|---|---|---|---|
| Ground plane size | 0.11 λ× 0.11 λ | 0.2λ × 0.26 λ | 0.176 λ× 0.208 λ | 0.06 λ× 0.076 λ |
| Antenna Height | 0.11 λ | 0.026 λ | 0.04 λ | 0.024 λ |
| Antenna Volume | $1.3 \times 10^{-3}\ \lambda^3$ | $1.4 \times 10^{-3}\ \lambda^3$ | $1.7 \times 10^{-3}\ \lambda^3$ | $9 \times 10^{-5}\ \lambda^3$ |
| Bandwidth | 2.1% (−3 dB) | 2.26% (−10 dB) | 8.3% (−10 dB) | 2.45% (−3 dB) |
| Gain (dBi) | NA | 0.75 | −0.7 | −1.35 |
| Efficiency | 84% | NA | 52% | 48.53% |
| Operating frequency (MHz) | 394 | 1946 | 24000 | 916 |

The total volume of FICA in this work is within 7% of other ESAs. On the other hand, the volume of the other ESAs is too big to fit into a WSN transceiver node.

To implement the complete Wireless Sensor Network system, the streamlined, miniaturized antenna in question, and an emerging family of system-on-chip (SoC) devices were integrated in a single-chip device for performing computation and communication tasks. An acoustic sensor was integrated for sensing tasks.

The performance of the low profile, small volume FICA antennas was tested through communication range measurements with a custom-designed application-specific WSN. On each WSN node containing a Chipcon CC1110 a microphone sensor, an antenna, a transceiver circuit, and a battery were integrated into a prototype wireless sensor network device. All components were stacked together as depicted in FIG. 12. When used in WSN transceiver nodes, the antenna was fed through a wire that carries signals into and from the transceiver IC that was soldered on the back of the PCB. This 3-dimensional integration minimizes the total volume of the communication nodes. Each node can transmit and receive a sensed sound signal according to a time division multiple access (TDMA) protocol at designated time slots. The sensor networks operated in the frequency band between 906 MHz to 926 MHz, with center frequency at 916 MHz.

The maximum communication distance of the FICA was compared to an 88 mm long commercial whip antenna (ANT-916-CW-RCL from Antenna Factor) at the same frequency. The field range measurements showed that the sensor network may work properly up to a distance of 7.3 m between FICA nodes. This is a reasonable communication range in WSNs (5 m to 10 m). By using the commercial 88 mm whip antenna, this distance could be improved only to 7.6 m. These results show that the FICA is a good candidate for application in compact communication nodes.

The reflection coefficient at the feeding point of the antenna was measured through the Agilent Network Analyzer (PNA Series 8364B). The center frequency of the miniature antenna was 916 MHz, with a return loss of 20 dB and bandwidth of 13 MHz.

A compact and low power, distributed, sensor network system for line crossing recognition was developed with a distributed algorithm for the line crossing recognition useful in reducing the amount of data that must be communicated across nodes in the network. The communication protocol was employed which carefully manages the duty cycle to achieve further improvements in energy efficiency.

The novel antenna 10 integrated into the Dust Sensor node was successfully tested in a multi-node Wireless Sensor Network for Line Crossing Recognition in which sensor nodes are positioned along a line enveloping an area of interest and communicate each with the other to make a decision on the border crossing.

The parameters for the mass manufacturing of the compact antenna for SmartDust application have been defined, e.g., the wire diameter, coil spacing, major and minor radius of the coils, number of turns, vertical pin height, bending position, and bending angle. The most critical dimension that leads to a large gain variation is the tapping point. All of the above parameters have been analyzed through HFSS simulations to optimize the FICA performance. In manufacturing process, the wire of the antenna can be wound on a mandrel, shaped and cut with 0.1 mm precision, which provides duplicable antenna performance. When used in WSN transceiver nodes, the antenna is fed through a wire that carries signals into and from the transceiver IC that is soldered on the back of the PCB.

The designed antenna was successfully scaled to operating frequencies higher than 916 MHz, such as 2000-2500 MHz bands with comparable performance whereas the volume was significantly reduced.

The description above is intended to illustrate possible implementations of the present invention and is not restrictive. Many variations, modifications and alternatives will become apparent to the skilled artisan upon review of the disclosure. For example, method steps equivalent to those shown and described may be substituted therefore, elements and method individually described may be combined, and methodologies described as discrete may be distributed across many algorithm techniques. The scope of the invention should therefore be determined not with reference to the particular description above, but with reference to the appended claims, along with their full range of equivalence.

The invention claimed is:

1. An F-inverted compact antenna for ultra low volume Wireless Sensor Networks (WSN), comprising:

a ground plane board, a dielectric block attached to a surface of said ground plane board at a predetermined location thereof, and a helically contoured member attached to said dielectric block and disposed with an axis of said helically contoured member extending substantially in parallel to said surface of said ground plane board, said helically contoured member including a pre-wound wire portion having a first end and a second end and a plurality of coils between said first and second ends, and a wire part coupled at a tapping end thereof to said pre-wound wire portion at a predetermined tapping point, wherein said first end of said pre-wound wire portion and another end of said wire part opposite to said tapping end thereof are coupled respectively to feeding and shorting points of said compact antenna.

2. The compact antenna of claim 1, wherein said helically contoured member is formed from a wire of a diameter approximating in the range between 0.5 mm and 0.8 mm.

3. The compact antenna of claim 1, wherein said wire is made of copper.

4. The compact antenna of claim 1, wherein said tapping point is located a predetermined distance ranging between 5 mm and 13.57 mm from said feeding point.

5. The compact antenna of claim 1, wherein said ground plane board has dimensions in the range below 10-20 mm×12-25 mm.

6. The compact antenna of claim 1, further comprising a connector coupled to said antenna through a feeding pin, wherein said ground plane board has a feeding opening formed therein, wherein said feeding pin of said connector extends through said feeding opening, and wherein said first end of said pre-wound wire portion is coupled to said feeding pin.

7. The compact antenna of claim 1, wherein said ground plane board is fabricated from FR4 with a layer of copper plate embedded therein.

8. The compact antenna of claim 1, wherein said another end of said wire part is shorted to said ground plane board.

9. The compact antenna of claim 1, wherein said dielectric block is shaped with a plurality of receiving structures of dimensions and disposition cooperating with dimensions and shape of said helically contoured member, each of said plurality of coils of said pre-wound wire portion being secured in a respective one of said receiving structures.

10. The compact antenna of claim 9, wherein said receiving structures are formed as grooves extending substantially in parallel each to the other.

11. The compact antenna of claim 9, wherein said receiving structures are formed as channels passing through said dielectric block, each channel receiving a respective one of said plurality of coils of said pre-wound helically contoured member.

12. The compact antenna of claim 1, wherein said pre-wound wire portion is formed from a wire having a length depending on the bandwidth of said compact antenna.

13. The compact antenna of claim 6, wherein said connector is an SMA connector.

14. The compact antenna of claim 1, wherein for the operating frequency of said compact antenna in the range of 906 MHz-926 MHz, a volume occupied by said compact antenna is below approximately $0.06\lambda \times 0.076\lambda \times 0.024\lambda$, wherein $\lambda$ is a resonating wavelength of said compact antenna.

15. The compact antenna of claim 14, wherein a spacing between said coils is approximately 2.5 mm.

16. The compact antenna of claim 1, wherein for the operating frequency in the range of 2.2-2.45 GHz, a volume occupied by said compact antenna is below approximately 10 mm×10 mm×10 mm.

17. The compact antenna of claim 12, wherein the length of said wire is in the range approximately 30 mm-50 mm for the operating frequency in the range of 2.2 GHz-2.45 GHz.

18. A method for manufacturing an F-inverted compact antenna for ultra-low volume Wireless Sensor Networks (WSN), comprising the steps of:

providing a ground plane board of predetermined dimensions compatible with the ultra-low volume WSN, forming a dielectric block having a plurality substantially parallel receiving structures of predetermined dimensions, and spaced predetermined distance one from another, attaching said dielectric block to a surface of said ground plane board at a predefined position thereof, pre-winding a wire of a predetermined length and diameter into a helically contoured member having a plurality of coils coordinated with said receiving structures of said dielectric block, said helically contoured member having a first end and a second end, coupling a tapping end of a wire part of a predetermined length to a predetermined tapping location of a respective one of said plurality of coils, attaching said helically contoured member to said dielectric block with the axis of said helically contoured member extending substantially in parallel to said surface of said ground plane board, wherein each of said plurality of coils of said helically contoured member is received in a respective one of said plurality of receiving structures of said dielectric block, and coupling said first end of said helically contoured member to a feeding point, and shorting said wire part to said ground plane board.

19. The method of claim 18, further comprising the steps of:

after coupling said antenna to the feeding point, measuring a resonating frequency of a helically contoured member with said wire part coupled thereto, and trimming said predetermined length of said pre-wound wire until said resonating frequency approximately approaches a desired operating frequency of said compact antenna.

20. The method of claim 18, wherein said compact antenna occupies a volume on a mm scale, further comprising the steps of:

integrating said compact antenna with an ultra small smart sensor network transceiver.

* * * * *